US008636441B2

(12) United States Patent
French

(10) Patent No.: US 8,636,441 B2
(45) Date of Patent: Jan. 28, 2014

(54) DUAL DIRECTION PRE-STRESSED PRE-TENSIONED PRECAST CONCRETE SLABS AND PROCESS FOR SAME

(75) Inventor: Phillip French, Acampo, CA (US)

(73) Assignee: Con-Fab CA. Corporation, Lathrop, CA (US)

( * ) Notice: Subject to any disclaimer, the term of this patent is extended or adjusted under 35 U.S.C. 154(b) by 0 days.

(21) Appl. No.: 13/068,224

(22) Filed: May 5, 2011

(65) Prior Publication Data

US 2012/0282025 A1 Nov. 8, 2012

(51) Int. Cl.
*E01C 5/08* (2006.01)

(52) U.S. Cl.
USPC ..... 404/45; 404/70

(58) Field of Classification Search
USPC ..... 404/45, 70
See application file for complete search history.

(56) References Cited

U.S. PATENT DOCUMENTS 1,475,847 A * 11/1923 Marks ..... 52/600
2,590,685 A * 3/1952 Coff ..... 404/70
2,667,060 A * 1/1954 Campbell ..... 52/565
2,833,186 A * 5/1958 Dobell ..... 264/34
2,921,354 A * 1/1960 Pankey et al. ..... 249/9
2,950,517 A * 8/1960 Brickman ..... 264/35
3,089,215 A * 5/1963 Stubbs ..... 425/111
3,513,609 A * 5/1970 Lang ..... 52/223.6
4,056,908 A * 11/1977 McManus ..... 52/334
4,621,943 A * 11/1986 Swanson ..... 404/70
6,435,765 B1 * 8/2002 Crane et al. ..... 404/31

* cited by examiner

*Primary Examiner* — Gary Hartmann
(74) *Attorney, Agent, or Firm* — Jacobson Holman PLLC

(57) ABSTRACT

A precast roadway slab is pre-tensioned longitudinally and transversely, and may also be post-tensioned. A casting bed has the capability of permitting pre-tensioning of a concrete cast to be carried out within the casting bed in both the longitudinal direction and in the transverse direction. Slots are provided at regular intervals within the side walls and jacking heads of the casting bed for tensioning wires to pass therethrough for pre-tensioning. The process utilizes a multilayer grid of pre-tensioning wires disposed within the casting bed, prior to pouring of the concrete. The cast concrete product can also be made with optional tubular ducts, laid parallel to the longitudinal wires, for post-tensioning subsequent to the cast of the concrete. The post-tensioning of the hardened cast, if called for, takes place at the job site.

9 Claims, 4 Drawing Sheets

100
101
102
103
104
105
107
109
10
010
011
012
013
014
015
016

DUAL DIRECTION PRE-STRESSED PRE-TENSIONED PRECAST CONCRETE SLABS AND PROCESS FOR SAME

BACKGROUND OF THE INVENTION

1. Field of Invention

This invention pertains to the field of pre-stressed pre-tensioned precast concrete slabs to be used for paving in areas subject to vehicular traffic.

2. Description of the Prior Art

Prestressed concrete is a mode of construction that overcomes concrete's inherent weakness in tension. When concrete is prestressed using one of three means available, longer spans can be created as measured against ordinary reinforced concrete. Traditional reinforced concrete uses steel rebar or other reinforcement material disposed within the concrete to reinforce it. Typically a swimming pool bottom is made in this manner. Prestressed concrete employs cables or strands to provide a clamping load which produces a compressive stress that can balance the tension stress that the concrete member would otherwise exhibit due to a bending load.

Pre-stressed concrete can be either pre-tensioned, or post tensioned. Pre-tensioned concrete is cast around already tensioned tendons. The concrete is poured around the pre-tensioned cables or tendons, and the concrete adheres to the tendons or cables as the concrete hardens during the curing process. When the tension is released from the tendons/cables this tension is transferred to the hardened concrete and compression by static friction thus creating concrete in compression. To achieve the pre-tensioning, anchor points are attached on opposite ends of the casting bed, between which, the tendons or wires are stretched in a straight line. When the tension is released, the tension is transferred to the hardened concrete unit by static friction.

Post-tensioned concrete is the mode for applying compression after the pouring and curing in situ of the concrete. There are two modes of doing so, one is called Bonded and the other is called Un-bonded.

In the bonded version, plastic, steel, or aluminum ducts, or tubes are laid out in a finite area, and the concrete is poured over and around the series of parallel tubes. Post tension cables are deployed through the tubes. Once the concrete hardens, the tendons are anchored at one end and tensioned at the other end using hydraulic jacks or rams that now react against the hardened concrete. After reviewing the design specification to confirm that adequate tension has been placed on the tendons, the jacks are removed such that the tension is now applied directly to the concrete member. The ducts or tubes are then grouted closed to protect the tendons from corrosion and decomposition. Concrete slabs prepared in this manner are usually used for bridges and house construction for slabs on grade in areas where the soil is expansive.

In the unbonded system each individual cable has freedom of movement relative to the concrete at all times. Each individual tendon is coated with a grease, often lithium based, and perhaps molybdenum sulfide would work also. Then the tendons are covered by an extruded plastic sheathing. The tension transfer arises from the tendons being connected to anchors embedded in the perimeter of the cast concrete slab. While the generalized discussion of post-tensioning serves as an introduction to the topic, more information can be obtained from the Post-tensioning institute which in the year 2011 is located at 8601 North Black Canyon Highway in Phoenix, Ariz.

Pre-stressed, Pre-tensioned concrete can not only be used for buildings, but is used today in Bridge work and the manufacture of roads. Pre-stressed paving slabs can be laid into position during off-peak hours on nights and weekends. This minimizes lane closures, which can cause huge traffic back-ups, especially on highly traveled interstate freeways. The big advantage of using pre-stressed concrete slabs, is the relative speed of placement on site, less cracking, and the ability to use relatively thinner and longer slabs. Longer slabs reduce the number of joints that must be maintained. Basically whereas standard construction can take weeks for a project, the same project can be carried out in days using pre-stressed, pre-cast concrete slabs.

Numerous patents that relate to a method of forming, installing and a system for attaching prefabricated pavement slab to a subbase, and to the pavement slab itself have been issued to Peter J. Smith and said patents have been assigned to the Fort Miller Group, Inc. of Greenwich, N.Y. Some of these patents include:

| | |
|---|---|
| U.S. Pat. No. 6,709,792 | Issued Mar. 24, 2004 |
| U.S. Pat. No. 6,607,329 | Issued Aug. 19, 2003 |
| U.S. Pat. No. 6,899,489 | Issued May 31, 2005 |
| U.S. Pat. No. 6,962,462 | Issued Nov. 8, 2005 |
| U.S. Pat. No. 7,004,674 | Issued Feb. 28, 2006 and |
| U.S. Pat. No. 7,467,776 | Issued Dec. 23, 2008 |

Another inventor in this technology is Alfred A. Yee, whose two patents are assigned to Kwik Slab, LLC of Honolulu, Hi. His patents are U.S. Pat. No. 7,134,805 which issued on Nov. 14, 2006 and the published application 2005/0220539.

The Fort Miller Group product(s) are sold under the brand Super Slab, whereas the Yee products are sold under the brand Kwik Slab. It is believed that none of the aforementioned eight references singly or in combination disclose or render obvious the invention of this current patent application.

The reason that this assertion can be made is that the invention of this patent application relates to an entirely new technique for pre-stressing, pre-tensioning concrete slabs in 2 directions, not just one direction as has been the case with the prior art techniques.

As hinted above, the invention herein relates to a procedure for pre-stressing, pre-tensioning concrete slabs both longitudinally and transversely. The process further relates to the utilization of these bi-directionally pre-stressed, pre-tensioned slabs in the laying of roadways.

In order to better understand this invention it is necessary to lay the foundation—no pun intended—of the general technique for making roadway sections. As noted above, pre-stressing can be accomplished by pre-tensioning or post tensioning. Pre-tensioning is done in the concrete casting bed, prior to the pouring of concrete, while post tensioning is done after concrete is poured and sufficiently hardened. Most concrete roadways are normally laid in up to 224 foot lengths between expansion joints. These sections are made of a plurality of slabs 12 feet wide and 8 foot long. These slabs can be connected by a variant of a tongue and groove connection or some other type of joint. The joints are then grouted or otherwise treated to form a complete section of concrete roadway. This means that in this 224 foot span there will be 28 grout joints. 8 feet long×28=224 feet.

Generally pre-stressing in the concrete casting bed of a 12 foot length is carried out by pre-tensioning in the 12 foot direction prior to the pouring of the concrete and post-tensioning through the use of tendons or wires in a duct system after installation. But the pre-tensioning in the prior art techniques is in only one direction, longitudinally. The process of this invention is pre-stressing, pre-tensioning the concrete in both directions, longitudinally and laterally using a pre-tension technique longitudinally and laterally. Optional post-tensioning may also be applied. This allows for the preparation of longer slabs, potentially up to 60 feet in length, thereby minimizing the number of joints to be grouted and maintained in each roadway section, and thus speeding up the installation process.

The invention accordingly comprises the apparatus (casting bed) and the device (dual direction, pre-stressed, pre-tensioned) concrete slab and the process of making the device, each of which possesses the features, properties, the selection of components which are amplified in the following detailed disclosure, and the scope of the application of which will be indicated in the appended claims.

SUMMARY OF THE INVENTION

The invention herein pertains to a process for bi-directionally pre-stressing, pre-tensioning concrete slabs of varying lengths for use in the repair of and creation of new areas subject to vehicular traffic, such as roadways and driveways. Individual slabs of a nominal 12 foot width, or of a width as may be required or dictated by the specific job requirement or specification are poured in varying lengths, possibly up to 60 foot long to suit site conditions and to meet the specification for the locations of expansion joints between adjacently positioned slabs. For the purpose of demonstrating this invention individual slabs 12 foot wide X 36 foot long were poured. Whereas the prior art pours 12 feet long slabs only 8 feet wide, pre-tensioned only in the 12 foot direction and then the prior art positions multiple pieces rotated 90 degrees to achieve the 12 foot wide roadway section; the process of this invention utilizes 12 foot wide casts of varying lengths, pre-tensioned in both directions having been poured in the same direction as the job site positioning(non-rotated).

It is well known in patent law that merely changing a dimension is not alone a patentable improvement. But his invention involves more than just a new dimension or a new casting technique. The pre-stressing of this application is done by pre-tensioning in both the longitudinal and the transverse direction prior to pouring the concrete with the optional post tension procedure after installation at the job site.

Prior to the concrete pour the metal multi-strand wire for the pre-tensioning step are laid in place both longitudinally and transversely. The location at or near the mid-height of the slab to be poured for the wire positions, as well as strand size and pre-stressing force of the longitudinal strands are determined by the design criteria-specification. Transverse strands are laid out in the mid-section of the slab to be at heights that can vary a few inches up or down from this mid-point to allow for the optional placement of ducts for a post-tensioning step at the job site. If the design does call for job site post-tensioning procedure, then the post-tensioning duct is also laid within the slab at this time. Tension is applied to the strand, both the longitudinal and the transverse, and maintained. Any additional reinforcing steel that may be required, and any other embeds, inserts, sleeves, boxes or block-outs are also placed in the slab at this stage. The concrete pour is carried out, required surface finish is done, and the poured slab is allowed to cure in the casting bed. Conventional or accelerated curing aids can be employed. Thirty-six foot long spans were chosen specifically to be able to ship one slab per flat bed truck without exceeding the permit load limits.

Once a poured slab has attained sufficient strength per specifications and design criteria, the pre-tensioned, pre-stressed strand in both directions is cut, and the slab is removed to storage for further curing and final dressing up for shipping to the job site. A slab poured and cured in this manner is a slab that is pre-stressed, pre-tensioned in both directions, the subject of this new invention, with the option of post-tensioning conventional procedure to be carried out at the job site.

***

It is of course to be recognized that in order to carry to the bi-directional pre-tensioning, pre-stressing of this invention, it was first necessary to create a new type of casting bed. This new casting bed provided the capability to pre-tension the strand in both directions, longitudinally and transversely.

DESCRIPTION OF THE PREFERRED EMBODIMENT

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figures 1, 2:
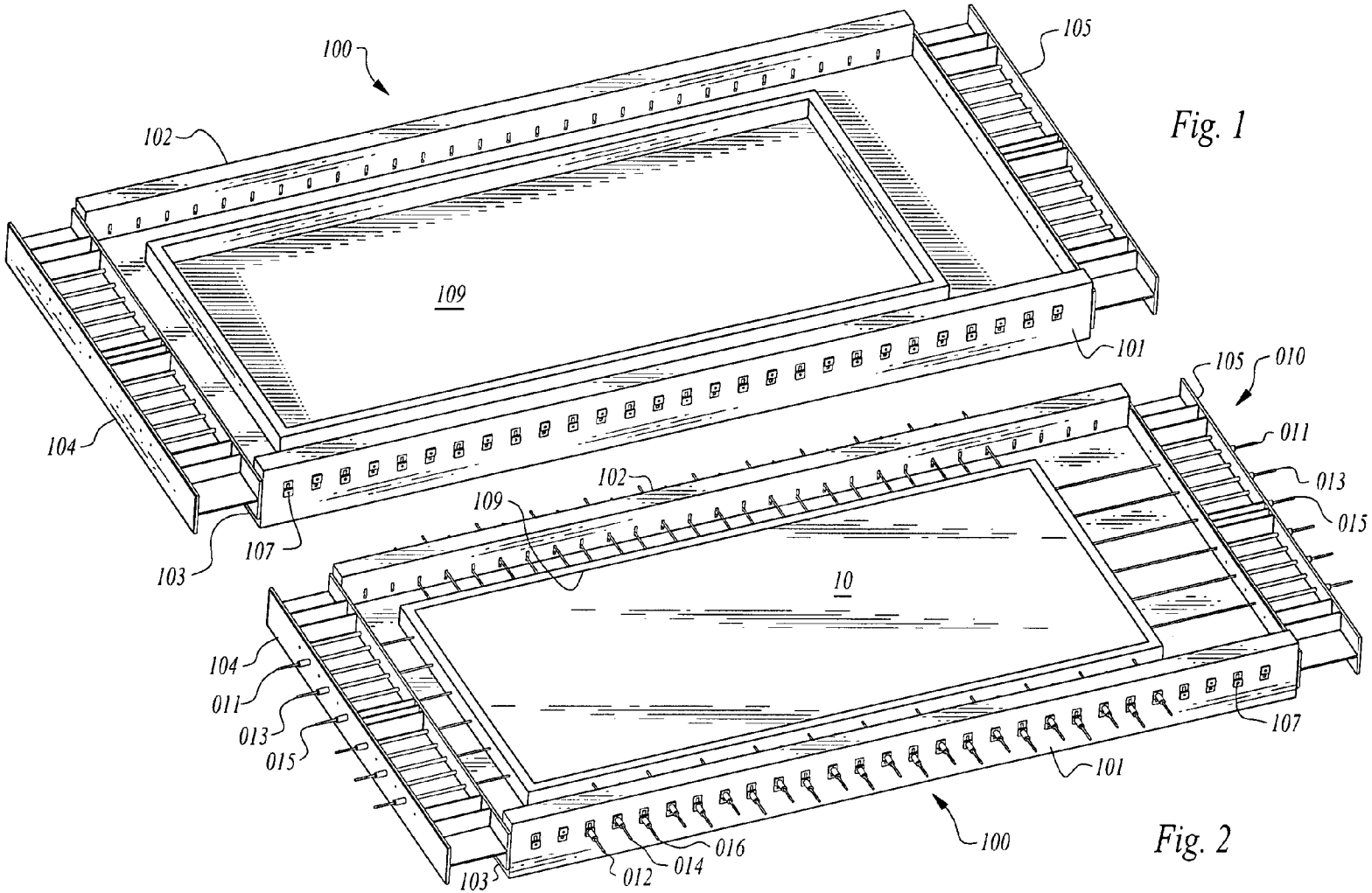
FIG. 1 is a perspective view of a model of the new concrete casting bed 100 of this invention.
FIG. 2 is the same perspective view at a later moment in time, after a cast of concrete 010 has been made in the casting bed 100.

Let us now turn to FIG. 1. Here a perspective view of the new casting bed is seen which permits the creation of the roadbed slabs of this invention. This FIGURE is not to scale. Casting bed 100 is a U-shaped member 100 having vertical spaced sidewalls 101,102 and a base 103 connected to both the sidewalls at the lower ends thereof Steel stressing heads 104 and 105, also called jacking heads both of which are optionally removable, close off the casting bed at each end and are used for longitudinal stressing, while slotted holes in the side walls are used for the transverse pre-tensioning. Form work of wood or steel, 200, placed within the casting bed at correct dimensions, defines the spatial volume, designated as the casting zone, 109. Disposed within the sidewalls 101,102 are throughbores 107 for the disposition of tensioning wires as will be described infra. These throughbores are linearly spaced apart along the length of the sidewalls and are aligned in pairs 90 degrees to the length of the side wall. Therefore when a tensioning wire is placed through any aligned pair, the wire will be 90 degrees to the length of the cast. These bores receive wires for transverse pre-tensioning of a concrete cast.

FIG. 2 is the same perspective view of the same casting bed, but with a cast of a slab of concrete having been carried out with pre-tensioning wires disposed in position prior to he cast. Here like numbers of FIG. 1 represent like parts here and in other views as well.

The cast 010 has been made in the casting zone 109 of FIG. 1. Disposed along the length thereof are a plurality of longitudinal pre-tensioning wires, here simplified to show only 3 in number, they being 011,013, & 015. Transverse pre-tensioning wires which have been reduced in number for ease and convenience, and are designated 012,014, & 016 are shown exiting from some of the bores of the side wall 101. These transverse pre-tension wires also exit the side wall 102, but due to the perspective of the figure are not seen. Note that the tensioning takes place PRIOR to the concrete cast.

Figure 3:
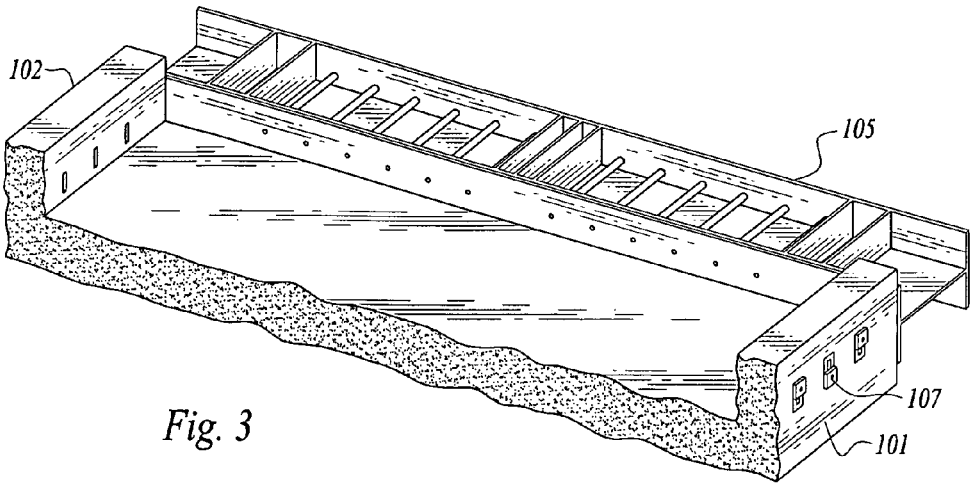
FIG. 3 is a top perspective view of part of a concrete casting bed according to this invention

FIG. 3 is a perspective view of a portion of the casting bed of this invention. Element 100 is a steel jacking head used for pre-tensioning the longitudinal strands of wire.

Figure 4:
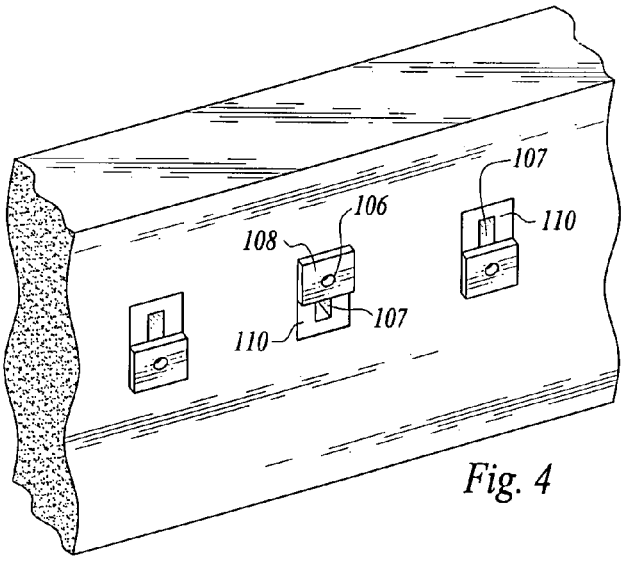
FIG. 4 is a side elevation of a portion of the side wall of the casting bed of this invention.

FIG. 4 is a closeup view of a portion of the sidewall of the concrete casting bed showing the main plates 110, and the slots 107 therein. A terminal plate, or washer plate 108 is removably disposed within the respective main plate 110 and has a round opening 106 therein, through which round opening the pre-tension wire is positioned for tensioning prior to the cast being made. Note that the 3 slots 107 shown are elevationally aligned, while the openings 106 are not aligned. This is intentional as alternating slots are disposed either above or below the longitudinal pre-tensioning wires, not seen, that are to be disposed within the concrete cast.

Figure 5:
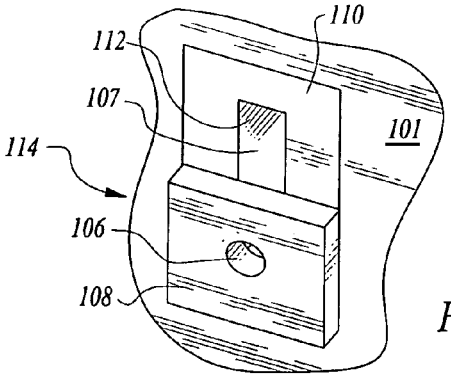
FIG. 5 is a closeup view of a slot formed in a stress wall for transverse stressing, showing a stress plate embedded in concrete and a stress washer plate welded thereto.

FIG. 5 is a macro-closeup of a vertical slot 107 in the sidewall of the casting bed. This permits the specific pre-tensioning wire to be placed "high" or "low", that is above or below the longitudinal pre-tensioning wires, as may be desired. Main metal plate 110 is attached to the sidewall 101 of the casting bed, and said plate includes a vertical slot 112, that communicates with the opening 106 of the terminal plate 108. In this FIGURE, the point in time is such that the wire 12 has been removed from the washer plate, 108 and the wire 12 is sticking out of the casting bed.

Figure 6:
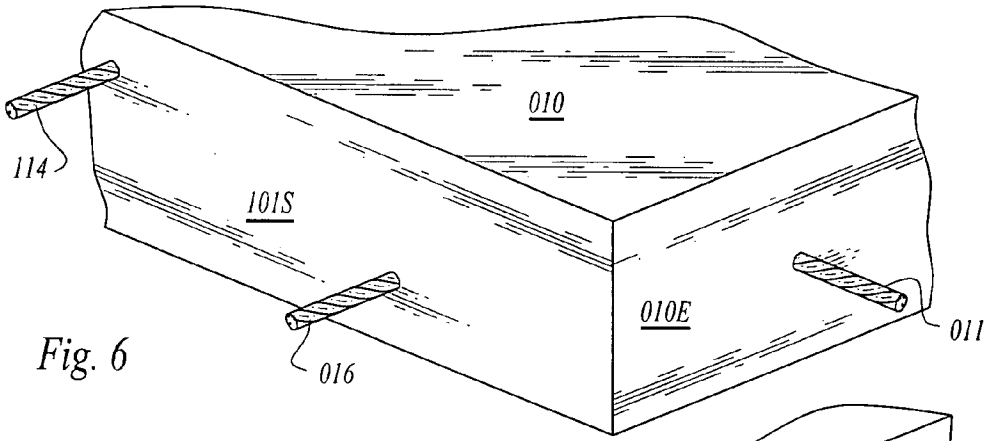
FIG. 6 is a front top perspective view of a portion of a long precast concrete slab, showing the presence of tensioning wires disposed in two directions.

FIG. 6 is a corner perspective view of a concrete cast 10,made in the casting bed 100 of this invention. Here 010E is the end wall, while 010S is the sidewall thereof. There is only one longitudinal pre-tension wire seen, 011. However two transverse pre-tension wires 016 and 014 are shown, each at a different elevation in accordance with the discussion infra of having transverse pre-tensioning cables both above and below the longitudinal ones, for the preferred embodiment. A cast of all equal level laterally positioned pre-tension wires either above or below the longitudinal pre-tensioning wires is within the scope of the invention, but need not be illustrated due to the simplicity of the concept.

Figure 7:
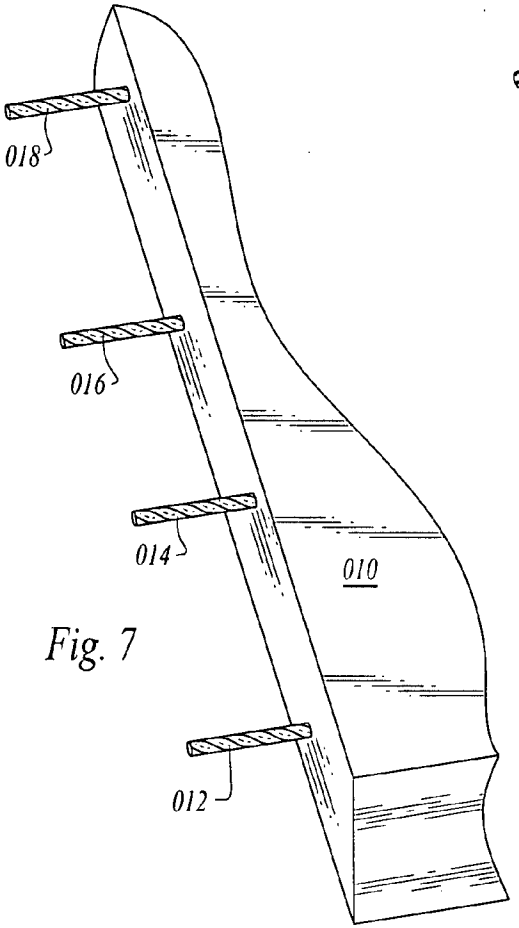
FIG. 7 is a top perspective view of the same slab, showing more of the length of the slab.

FIG. 7 is a view related to FIG. 6, but from a slightly different perspective. Here four lateral pre-tensioning wires are seen, showing wires 012 and 016 at the same elevation but 014 and 018 at the same elevation but which elevation is different from the elevation of 012 &016.

Figure 8:
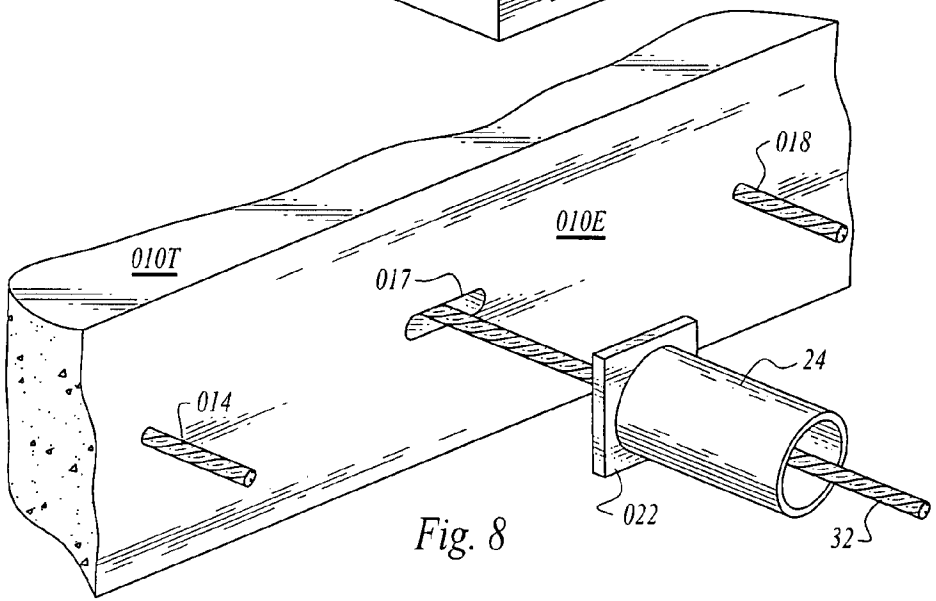
FIG. 8 is a side perspective view of the end of the cast slab of concrete showing a duct for post tension wire with the wire there through and an anchor disposed on the wire spaced from the duct as well as longitudinal pre-tensioned strands embedded in the slab.

FIG. 8 is a closeup of the top wall of the cast slab 010, designated 010T and the front end wall, 010E. Post tensioning slot 017 is seen to be elongated and extends through the full length of the cast. Post-tension wire 032 has been drawn or fed through a pre-placed PVC, duct metal or CPVC member called a horizontal duct 017 that is set in place before the concrete cast is made. This duct 017 runs the length of the cast. By making the duct shaped like a racetrack, it becomes easier to thread the post tension wire through the entire length than if a tubular duct is used. A tubular duct will work however, but is less preferred. Two pre-tensioning wires 014, and 018 are seen, one on either side of post tension wire 032. Whereas in FIG. 6,the plate 022 and stressing chuck 024 which are used conventionally in conjunction with the rams were disposed adjacent the cast, while here in FIG. 8 they are seen spaced from the cast to demonstrate assembly. The hydraulic rams that actually do the post-tensioning, for the longitudinal wires, are state of the art, and do not form any part of this invention and therefore are not shown.

Figure 9:
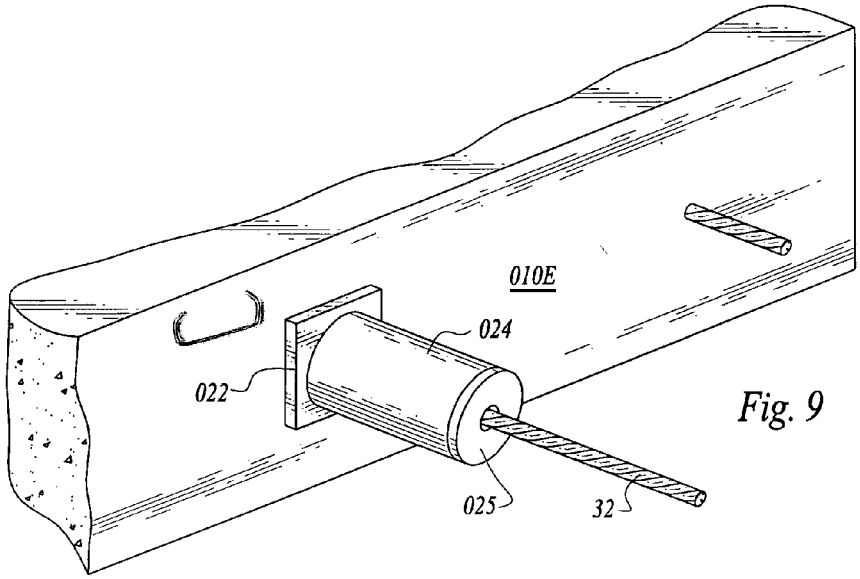
FIG. 9 is a figure related to FIG. 8 but showing the anchor disposed in position abutting the duct on the elevation of the slab.

FIG. 9 is a macro closeup of the elements discussed in FIGS. 6 & 8. However here the threaded end cap 025 that threads into stressing chuck 024 is seen.

Figure 10:
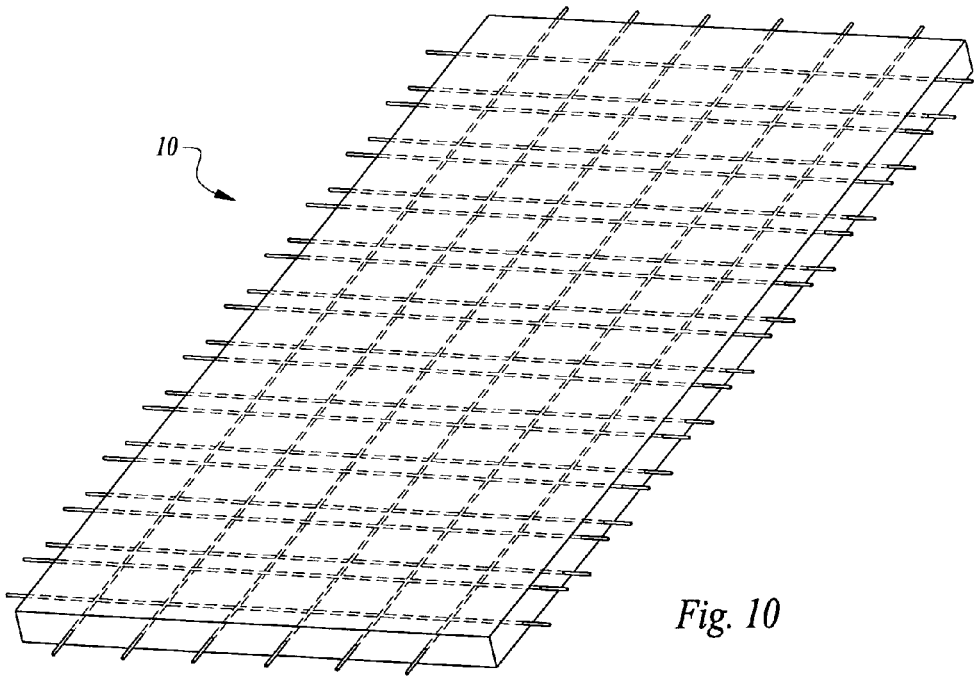
FIG. 10 is a roadway slab shown with the internal grid of both longitudinal pre-tensioned wires and transverse pre-tension wires, but the post tensioning ducts have been omitted for simplicity.

In FIG. 10 there is seen a three dimensional view of the grid pattern of the longitudinal pre-tension wires, and the two layers of transverse pre-tensioning wires, one layer above and one layer below the longitudinal wires disposed within a cast slab of concrete. The post tensioning ducts and wires have been omitted for simplicity of the FIGURE.

As has been noted earlier, the transverse wires can be above, below or both above and below the longitudinal direction pre-tension wires. All three layouts are within the scope of this invention. But the other two need not be illustrated as they are readily understood.

***

It has now been shown that extended length precast concrete slabs, can be prepared which have been pre-tensioned in both directions. The term pre-tensioning actually refers to the tensioning wires or cables utilized to apply tension to the concrete. This tensioning of the wires in both directions is done before the slab is cast, and the tension is transferred to the load once the cement cast is cured, when the stressing chucks that hold the tension to the wire are removed. In another sense, the designation pre-tensioning is meant to indicate that the tensioning is done before the slab is placed in location on a roadbed. After the cast and often at the job site, any further tensioning is termed POST-tensioning. In roadway construction, post tensioning takes place as the abutting sections of roadway are joined together by grouting.

By pre-tensioning in both directions at the factory before the cast is made, both labor and material costs are significantly reduced. Manufacturing costs are reduced because the wire placed in the cast slab prior to the cast is much lower in price than the wire that normally needs to be specially coated to protect it against corrosion inside the ducta within the cast after the cast has been made for traditional tensioning procedures.

It is seen that by building a special casting bed with tensioning capability built into the side walls of the casting bed that 36 foot long casts can be made, which will thereby permit the use of less seams and joints in assembling a road section thereby reducing costs for the contractor.

Since certain changes may be made in the above described apparatus—(casting bed) and the product thereof, —bidirectional pre-tensioned extended length concrete sections, without departing from the scope of the invention herein involved, it is intended that all matter contained in the above description and in the accompanying drawings, shall be interpreted as illustrative only and not in a limiting sense.

What is claimed is:

1. A precast roadway slab which comprises (i) a one piece casting of concrete, (ii) a plurality of spaced, first pre-tensioning elements extending in a longitudinal direction of the slab at a first elevation thereof, the first pre-tensioning elements being bonded to the concrete and in a detensioned state, and (iii) a plurality of spaced, second pre-tensioning elements extending in a direction substantially perpendicular to the longitudinal direction of the slab, the second pre-tensioning elements being (a) bonded to the concrete and in a detensioned state and (b) located at a second elevation of the slab that is spaced above the first elevation, and at a third elevation of the slab that is spaced below the first elevation, said concrete having a compressive force transferred thereto by said bonding of said detensioned first and second pre-tensioning elements to said concrete.

2. The precast roadway slab according to claim 1, further comprising a plurality of spaced ducts disposed within the slab, the plurality of spaced ducts being configured to receive therein a corresponding plurality of post-tensioning elements.

3. The precast roadway slab of claim 2, wherein a plurality of the spaced ducts extend in the longitudinal direction of the slab, and a plurality of the spaced ducts extend in the direction substantially perpendicular to the longitudinal direction of the slab.

4. The precast roadway slab according to claim 3, wherein the plurality of the spaced ducts extending in the longitudinal direction of the slab are at the first elevation.

5. A precast slab comprising:

(i) a casting of concrete;

(ii) a plurality of spaced, first pre-tensioning elements extending in a longitudinal direction of the slab at a first elevation thereof, the first pre-tensioning elements being bonded to the concrete and in a detensioned state; and (iii) a plurality of spaced, second pre-tensioning elements extending in a direction substantially perpendicular to the longitudinal direction of the slab, the second pre-tensioning elements being (a) bonded to the concrete and in a detensioned state and (b) located at a second elevation of the slab that is spaced above the first elevation, and at a third elevation of the slab that is spaced below the first elevation, said casting including therein a first compressive force in the longitudinal direction of the slab, the first compressive force being associated with the bonded and detensioned first pre-tensioning elements, and a second compressive force in the direction substantially perpendicular to the longitudinal direction of the slab, the second compressive force being associated with the bonded and detensioned second pre-tensioning elements.

6. The precast slab according to claim 5, wherein the first compressive force and the second compressive force are forces transferred by static friction from the bonded and detensioned first and second pre-tensioning elements to the casting of concrete.

7. The precast slab according to claim 5, wherein each of the first and second pre-tensioning elements is a metal, multi-strand wire.

8. The precast slab according to claim 5, further comprising a plurality of spaced ducts extending in the longitudinal direction of the slab, and a plurality of spaced ducts extending in the direction substantially perpendicular to the longitudinal direction of the slab, the plurality of spaced ducts being configured to receive therein a corresponding plurality of post-tensioning elements.

9. The precast slab according to claim 8, wherein each of the plurality of spaced ducts is configured as an elongated slot to facilitate placement of the post-tensioning element therein.

* * * * *